US007171768B2

(12) United States Patent
Klein

(10) Patent No.: US 7,171,768 B2
(45) Date of Patent: Feb. 6, 2007

(54) MODULAR SHOE SYSTEM

(75) Inventor: Mark Klein, Tel Aviv (IL)

(73) Assignee: Skins Footwear, Inc., New York, NY (US)

( * ) Notice: Subject to any disclaimer, the term of this patent is extended or adjusted under 35 U.S.C. 154(b) by 95 days.

(21) Appl. No.: 10/683,246

(22) Filed: Oct. 10, 2003

(65) Prior Publication Data

US 2005/0076539 A1 Apr. 14, 2005

(51) Int. Cl.

| | |
|---|---|
| ***A43B 3/24*** | (2006.01) |
| ***A43B 3/02*** | (2006.01) |
| ***A43B 3/16*** | (2006.01) |
| ***A43B 3/18*** | (2006.01) |
| ***A43B 7/14*** | (2006.01) |

(52) U.S. Cl. ..... 36/101; 36/7.1 R; 36/88

(58) Field of Classification Search ..... 36/100, 36/101, 15, 88, 93, 97, 99, 103, 10, 31, 114, 36/132, 136, 7.1 R, 7.2, 7.3

See application file for complete search history.

(56) References Cited

U.S. PATENT DOCUMENTS

| | | | | |
|---|---|---|---|---|
| 1,803,554 | A | 5/1931 | Knilans | |
| 4,120,103 | A * | 10/1978 | Colby | 36/97 |
| 4,267,649 | A | 5/1981 | Smith | |
| 4,267,650 | A | 5/1981 | Bauer | |
| 4,694,590 | A * | 9/1987 | Greenawalt | 36/91 |
| 4,706,316 | A | 11/1987 | Tanzi | |
| 4,813,162 | A * | 3/1989 | Harris | 36/88 |
| 5,065,531 | A | 11/1991 | Prestridge | |
| 5,282,288 | A | 2/1994 | Henson | |
| 5,570,523 | A | 11/1996 | Lin | |
| 5,595,005 | A | 1/1997 | Throneburg et al. | |
| 5,659,980 | A * | 8/1997 | Lin | 36/112 |
| 5,682,687 | A * | 11/1997 | Arai | 36/97 |
| 5,822,888 | A * | 10/1998 | Terry | 36/100 |
| 5,855,079 | A | 1/1999 | Herbert | |
| 6,023,857 | A * | 2/2000 | Vizy et al. | 36/30 R |
| 6,427,363 | B1 | 8/2002 | Hunter | |
| 6,594,922 | B1 * | 7/2003 | Mansfield et al. | 36/145 |
| 6,718,658 | B2 * | 4/2004 | Karasawa | 36/97 |
| 2002/0088145 | A1 | 7/2002 | Clark et al. | |
| 2002/0178613 | A1 | 12/2002 | Williamson et al. | |
| 2003/0088996 | A1 | 5/2003 | Hall | |

(Continued)

FOREIGN PATENT DOCUMENTS

| | | |
|---|---|---|
| EP | 541600 | 5/1993 |

(Continued)

*Primary Examiner*—Anthony Stashick
(74) *Attorney, Agent, or Firm*—Skadden, Arps, Slate, Meagher & Flom LLP

(57) ABSTRACT

A modular shoe system having interchangeable uppers and outsoles, comprising an internal support structure, a plurality of interchangeable first removable covers and a plurality of interchangeable second removable covers. The internal support structure includes a midsole, a heel counter and a toe box. The internal support structure has a front portion including the toe box and a rear portion including the heel counter. Each of the first removable covers includes a front upper and a front outsole. Each of the first removable covers is configured for being alternately removably attached to the front portion. Each of the second removable covers includes a rear upper and a rear outsole. Each of the second removable covers is configured for being alternately removably attached to the rear portion.

4 Claims, 10 Drawing Sheets

U.S. PATENT DOCUMENTS

| | | | |
|---|---|---|---|
| 2003/0088997 | A1 | 5/2003 | Mihailovich |
| 2003/0097770 | A1 | 5/2003 | Karasawa |
| 2004/0021242 | A1 | 2/2004 | Liu |
| 2004/0049942 | A1 | 3/2004 | Chen |
| 2004/0064976 | A1 | 4/2004 | Barteet |
| 2004/0093765 | A1 | 5/2004 | Baldwin |
| 2004/0107604 | A1 | 6/2004 | Ha |
| 2004/0159012 | A1 | 8/2004 | Keidel et al. |
| 2004/0231197 | A1 | 11/2004 | Yama |
| 2005/0005478 | A1 | 1/2005 | James |
| 2005/0022426 | A1 | 2/2005 | Clark |
| 2005/0034332 | A1 | 2/2005 | Moschel et al. |
| 2005/0055848 | A1 | 3/2005 | Miller et al. |
| 2005/0066543 | A1 | 3/2005 | Rosen et al. |
| 2005/0086836 | A1 | 4/2005 | Palmer et al. |
| 2005/0115113 | A1 | 6/2005 | Miller et al. |
| 2005/0115115 | A1 | 6/2005 | Lacey |
| 2005/0126044 | A1 | 6/2005 | Langley |
| 2005/0126045 | A1 | 6/2005 | Guidry |
| 2005/0166422 | A1 | 8/2005 | Schaeffer et al. |

FOREIGN PATENT DOCUMENTS

| | | |
|---|---|---|
| FR | 2813766 | 3/2002 |
| WO | WO 199202155 | 2/1992 |
| WO | WO 2004/066771 | 8/2004 |
| WO | WO 2004103105 | 12/2004 |

* cited by examiner

88

88
88

88

88

88

88

88

88

88

88

88

88

88

88

MODULAR SHOE SYSTEM

FIELD AND BACKGROUND OF THE INVENTION

The present invention relates to a modular shoe system and, in particular, it concerns a modular shoe having replaceable uppers and outsoles.

By way of introduction, a shoe typically includes a sole section and an upper section. The sole section includes an outsole or tread section, a midsole and an insole. The foot rests on the innersole and the outsole rests on the ground. The midsole is sandwiched between the innersole and the outsole. The uppers and outsole define the appearance of the shoe. There is a need for a modular shoe system having a midsole with replaceable uppers and outsoles due to a number of reasons. First, as fashions change there is a need to change the outside look of the shoe but not the midsole portion. Second, having a midsole with replaceable uppers and outsoles will reduce shoe production costs, reduce shoe storage in shops and at home in the closet.

Of relevance to the present invention is U.S. Pat. No. 1,803,554 to Knilans. Knilans teaches an athletic shoe having an elastic upper which may be inserted into or removed from a sole, heel counter and toe box. The toe box and heel counter portions are mechanically connected to the sole and cannot be changed. A shortcoming of the aforementioned system is that only part of the uppers are changeable. A further shortcoming of the aforementioned system is that the outsole cannot be changed. Another shortcoming of the aforementioned system is that the shape of the shoe cannot be changed.

Also of relevance to the present invention is U.S. Pat. No. 5,065,531 to Prestridge. Prestridge teaches a shoe having an upper portion and a sole-and-toe portion which are releasably joined together by a male/female track attachment. The upper portion includes the rear section of the uppers and the eyelets therein. A shortcoming of the aforementioned system is due to the tread being connected to the innersole and is not independently changeable. A further shortcoming of the aforementioned system is that only part of the uppers are changeable. Another shortcoming of the aforementioned system is that the shape of the shoes cannot be changed.

Of most relevance to the present invention is U.S. Pat. No. 5,822,888 to Terry. Terry teaches a reversible shoe having a removable midsole. The uppers are permanently joined to the outsole forming one piece. A shortcoming of the aforementioned system is due to the uppers having a zip or similar arrangement to hold the uppers in place on the midsole. The zip is visible, at least partially, and is prone to breaking. Another shortcoming of the aforementioned system is that the toe-cap is formed with the midsole and is not replaceable. A further shortcoming of the aforementioned system is that the uppers are not completely replaceable. Another shortcoming of the aforementioned system is that the shape of the shoe is restricted to the shape of the midsole structure.

Also of relevance to the present invention is U.S. Pat. No. 6,427,363 to Hunter. Hunter teaches a reversible shoe that can be taken apart and reassembled. The tippers are permanently joined to the tread forming one piece. The shoe is assembled using laces, snaps or buttons. An innersole is preferred but not essential. A shortcoming of the aforementioned system is due to the uppers having a laces, snaps or buttons to hold the uppers and tread together. The laces, snaps or buttons are visible and do not allow for convenient assembly and de-assembly of the shoe.

Therefore, there is a need for a modular shoe system having conveniently wholly replaceable uppers and outsoles without the need for additional fasteners in the uppers.

SUMMARY OF THE INVENTION

The present invention is a modular shoe system construction and method of operation thereof.

According to the teachings of the present invention there is provided, a shoe having interchangeable uppers and outsoles, comprising: (a) an internal support structure including a midsole; (b) a first removable cover including a front upper and a front outsole, the first removable cover configured for being removably attached to the internal support structure; and (c) a second removable cover including a rear upper and a rear outsole, the second removable cover configured for being removably attached to the internal support structure.

According to a further feature of the present invention: (a) the internal support structure includes a heel counter, the internal support structure has a rear portion which includes the heel counter; and (b) the second removable cover is configured for being removably attached to the rear portion.

According to a further feature of the present invention: (a) the internal support structure includes a toe box; (b) the internal support structure has a front portion which includes the toe box; and (c) the first removable cover is configured for being removably attached to the front portion.

According to a further feature of the present invention: (a) the internal support structure includes a toe box; (b) the internal support structure has a front portion which includes the toe box; and (c) the first removable cover is configured for being removably attached to the front portion.

According to a further feature of the present invention the first removable cover includes at least one filler section disposed therein, such that an outer shape of a toe section of the front upper is different from an outer shape of the toe box.

According to a further feature of the present invention, the first removable cover and the second removable cover are configured for being removably attached to the internal support structure substantially solely by pressure exerted by the internal support structure on the first removable cover and the second removable cover.

According to a further feature of the present invention, there is also provided a positioning arrangement configured for aiding a wearer of the shoe to position the first removable cover and the second removable cover relative to each other.

According to a further feature of the present invention, the internal support structure and the front outsole include complementary inter-engaging features for retaining the first removable cover in position on the internal support structure.

According to a further feature of the present invention, the complementary inter-engaging features include: (a) a pin disposed on one of the front outsole and the internal support structure; and (b) a hole disposed in another of the front outsole and the internal support structure.

According to a further feature of the present invention, the second removable cover includes a fastening arrangement configured for securing the shoe to a foot of a wearer.

According to a further feature of the present invention, the first removable cover includes a tongue configured for being disposed at least partially beneath the fastening arrangement.

According to a further feature of the present invention, the fastening arrangement includes a plurality of eyelets configured for inserting a shoelace through the eyelets.

According to a further feature of the present invention, the fastening arrangement includes a stretchable band.

According to a further feature of the present invention, the fastening arrangement includes a buckle.

According to a further feature of the present invention, there is also provided an insole disposed in the internal support structure.

According to a further feature of the present invention, the second removable cover includes a heel disposed thereon.

According to a further feature of the present invention, the internal support structure includes an elongated element disposed thereon, the elongated element being configured for inserting into the heel.

According to the teachings of the present invention there is also provided a modular shoe system having interchangeable uppers and outsoles, comprising: (a) an internal support structure including a midsole; (b) a plurality of interchangeable first removable covers, each of the interchangeable first removable covers including a front upper and a front outsole, each of the interchangeable first removable covers configured for being alternately removably attached to the internal support structure; and (c) a plurality of interchangeable second removable covers, each of the interchangeable second removable covers including a rear upper and a rear outsole, each of the interchangeable second removable covers configured for being alternately removably attached to the internal support structure.

According to a further feature of the present invention: (a) the internal support structure includes a heel counter and a toe box, the internal support structure having: (i) a front portion including the toe box; and (ii) a rear portion including the heel counter; (b) each of the interchangeable first removable covers is configured for being alternately removably attached to the front portion; and (c) each of the interchangeable second removable covers is configured for being alternately removably attached to the rear portion.

According to a further feature of the present invention, one of the first removable covers includes at least one filler section disposed therein, such that an outer shape of a toe section of the front upper of the one first removable cover is different from an outer shape of the toe box.

According to a further feature of the present invention, one of the first removable covers and one of the second removable covers are configured for being removably attached to the internal support structure substantially solely by pressure exerted by the internal support structure on the one first removable cover and the one second removable cover.

According to a further feature of the present invention, the midsole and the front outsole of one of the first removable covers include complementary inter-engaging features for retaining the one first removable cover in position on the internal support structure.

According to a further feature of the present invention, one of the second removable covers includes a fastening arrangement configured for securing the shoe to a foot of a wearer.

According to the teachings of the present invention there is also provided a shoe having interchangeable uppers and outsoles, comprising: (a) an internal support structure including a midsole; and (b) a removable cover arrangement including an upper and an outsole, the upper including a toe portion, the removable cover arrangement configured for being removably attached to the internal support structure.

According to a further feature of the present invention, the internal support structure and the removable cover include complementary inter-engaging features for retaining the removable cover in position on the internal support structure.

According to a further feature of the present invention, the removable cover arrangement is configured for being simply removably attached to the internal support structure.

According to a further feature of the present invention, the removable cover arrangement is configured for being removably attached to the internal support structure substantially solely by pressure exerted by the internal support structure on the removable cover arrangement.

According to a further feature of the present invention, removable cover arrangement includes: (a) a first removable cover including a front upper and a front outsole; and (b) a second removable cover including a rear upper and a rear outsole.

According to a further feature of the present invention, the internal support structure includes a heel counter.

According to a further feature of the present invention, the internal support structure includes a toe box.

According to a further feature of the present invention, the internal support structure includes a toe box.

According to a further feature of the present invention, the removable cover arrangement includes at least one filler section disposed therein, such that an outer shape of a toe section of the removable cover arrangement is different from an outer shape of the toe box.

According to a further feature of the present invention, the removable cover arrangement includes a fastening arrangement configured for securing the shoe to a foot of a wearer.

According to a further feature of the present invention, the removable cover arrangement includes a tongue configured for being disposed at least partially beneath the fastening arrangement.

According to a further feature of the present invention, the fastening arrangement includes a plurality of eyelets configured for inserting a shoelace through the eyelets.

According to a further feature of the present invention, the fastening arrangement includes a stretchable band.

According to a further feature of the present invention, the fastening arrangement includes a buckle.

According to a further feature of the present invention, there is also provided an insole disposed in the internal support structure.

According to a further feature of the present invention, the removable cover arrangement includes a heel disposed thereon.

According to a further feature of the present invention, the internal support structure includes an elongated element disposed thereon, the elongated element being configured for insertion into the heel.

According to the teachings of the present invention there is also provided a modular shoe system having interchangeable uppers and outsoles, comprising: (a) an internal support structure including a midsole; and (b) a plurality of interchangeable removable cover arrangements, each of the interchangeable removable cover arrangements including an upper and an outsole, each of the interchangeable removable cover arrangements configured for being alternately removably attached to the internal support structure substantially solely by pressure exerted by the internal support structure on the removable cover arrangements.

According to a further feature of the present invention, each of the interchangeable removable cover arrangements includes: (a) a first removable cover including a front upper and a front outsole; and (b) a second removable cover including a rear upper and a rear outsole.

BRIEF DESCRIPTION OF THE DRAWINGS

The invention is herein described, by way of example only, with reference to the accompanying drawings, wherein:

FIG. 5*a* is a sectional view of a modular shoe system that is constructed and operable in accordance with a first alternate embodiment of the present invention;

FIG. 5*b* is a partial view of a modular show system of FIG. 5*a* having a section of the removable cover cut away;

DESCRIPTION OF THE PREFERRED EMBODIMENTS

The present invention is a modular shoe system construction and method of operation thereof.

The principles and operation of a modular shoe system according to the present invention may be better understood with reference to the drawings and the accompanying description.

Figure 1A:
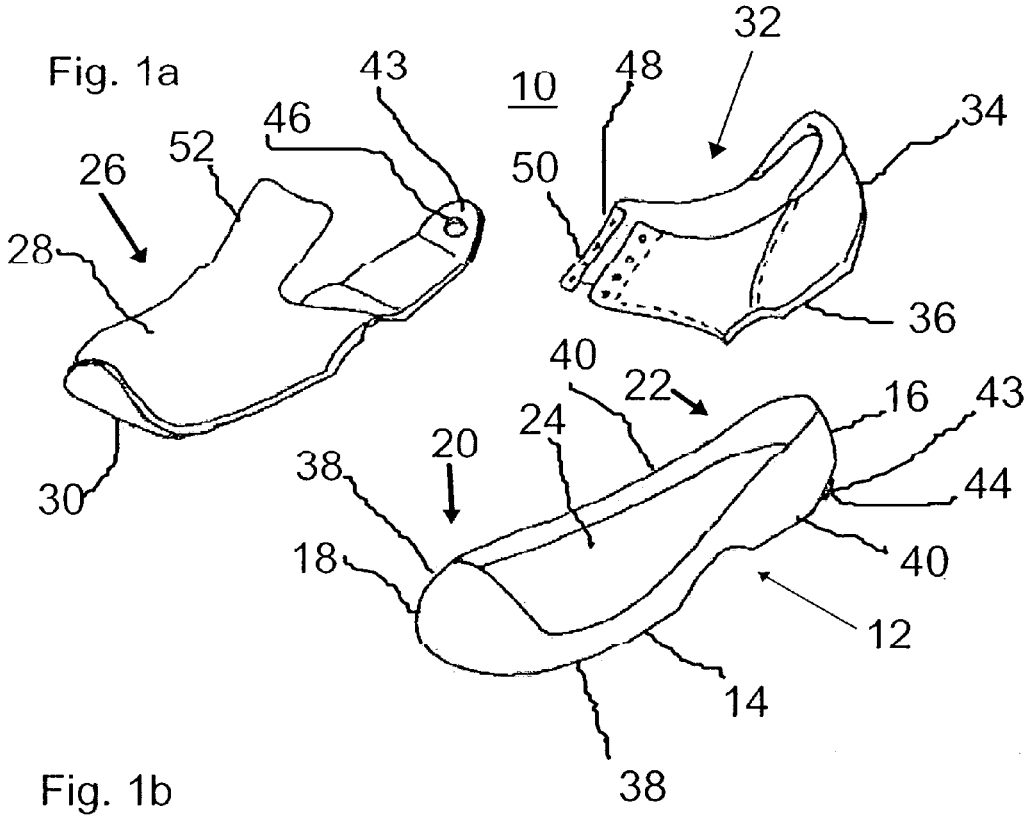
FIG. 1*a* is an isometric view of a modular shoe system that is constructed and operable in accordance with a preferred embodiment of the present invention.
Figure 1B:
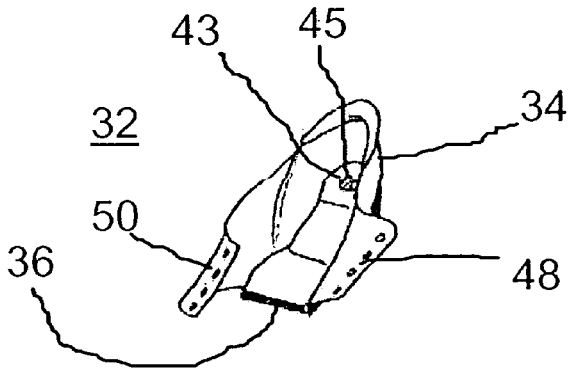
FIG. 1*b* is an isometric view of a rear removable cover of the modular shoe system of FIG. 1*a;*
Figure 1C:
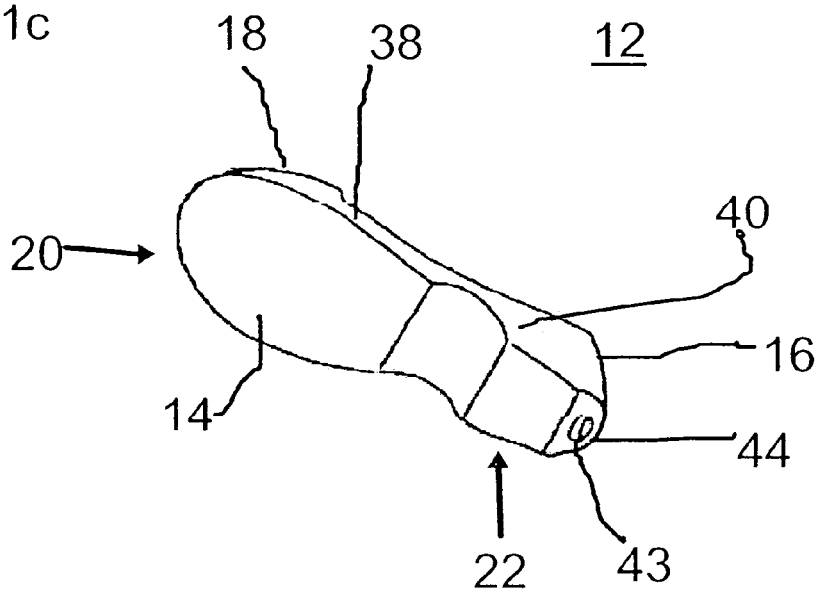
FIG. 1*c* is an isometric view of the base of an internal support structure of the modular shoe system of FIG. 1*a;*
Figure 1D:
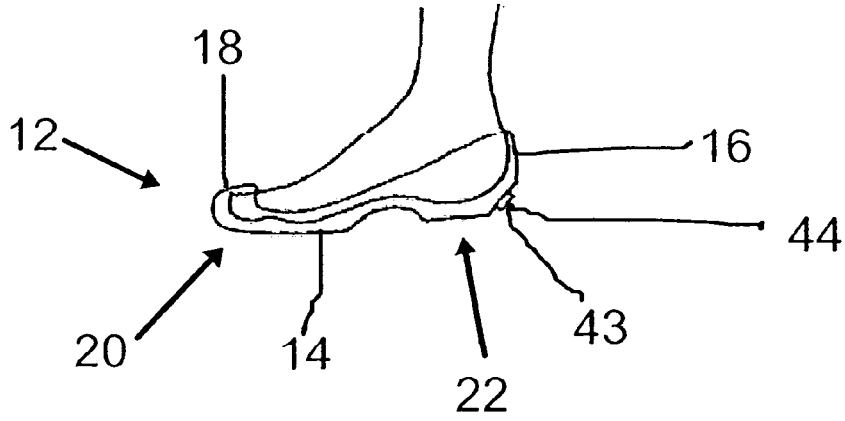
FIG. 1*d* is a cross-sectional view of the internal support structure of FIG. 1*c* being fitted to a foot.
Figure 1E:
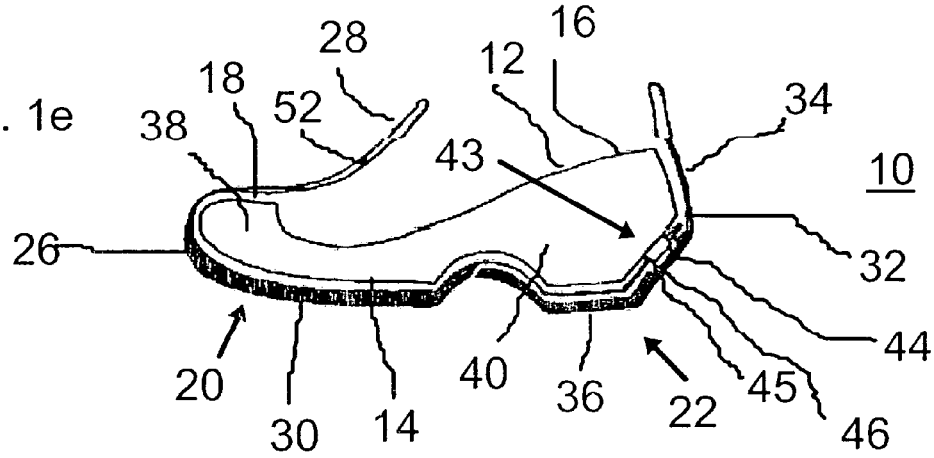
FIG. 1*e* is a sectional view of the modular shoe system of FIG. 1*a* in an assembled state.
Figure 1F:
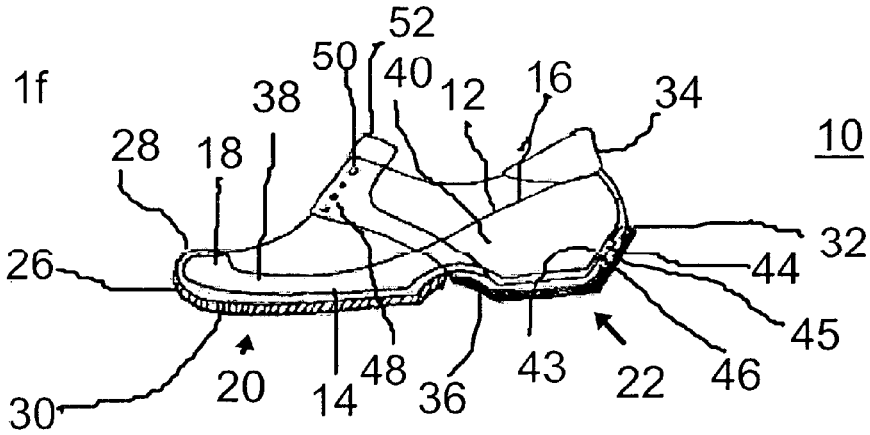
FIG. 1*f* is a schematic view of the modular shoe system of FIG. 1*a* in an assembled state.
Figure 1G:
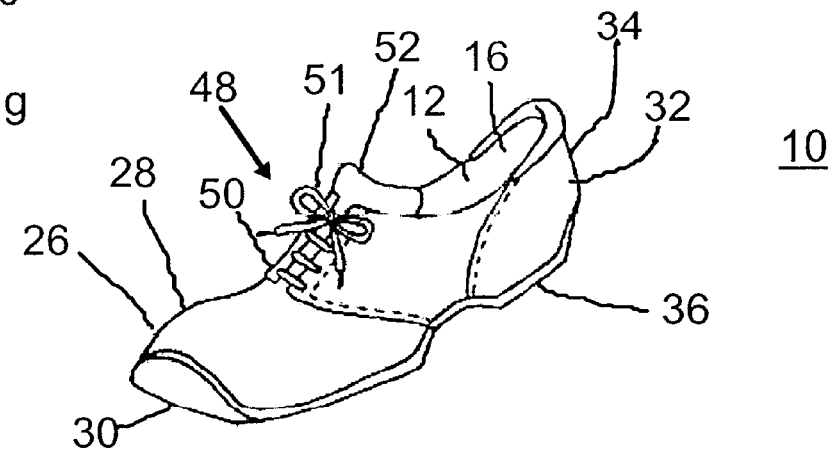
FIG. 1*g* is an isometric view of the modular show system of FIG. 1*a* in an assembled state.

Reference is now made to FIGS. 1*a* to 1*g*. FIG. 1*a* is an isometric view of a modular shoe system 10 that is constructed and operable in accordance with a preferred embodiment of the invention. FIG. 1*b* is an isometric view of a rear removable cover 32 of modular shoe system 10. FIG. 1*c* is an isometric view of the base of an internal support structure 12 of modular shoe system 10. FIG. 1*d* is a cross-sectional view of internal support structure 12 being fitted to a foot. FIG. 1*e* is a sectional view of modular shoe system 10 in an assembled state. FIG. 1*f* is a schematic view of modular shoe system 10 in an assembled state (for the sake of clarity and presentation, certain features which would otherwise be hidden are shown making other features semi-transparent). FIG. 1*g* is an isometric view of modular shoe system 10 in an assembled state. Modular shoe system 10 includes internal support structure 12. Internal support structure 12 includes a midsole 14, a heel counter 16 and a toe box 18. Internal support structure 12 has a front portion 20 which includes toe box 18. Internal support structure 12 has a rear portion 22 which includes heel counter 16. Internal support structure 12 also includes an insole 24 disposed therein (FIG. 1*a*).

Modular shoe system 10 includes a plurality of interchangeable first removable covers, for example, a removable cover 26. Other examples of suitable first removable covers are described with reference to FIGS. 4 to 7*v*. Removable cover 26 includes a front upper 28 and a front outsole 30. Each of the first removable covers is configured for being alternately removably attached to front portion 20. When modular shoe system 10 is assembled, removable cover 26 substantially covers toe box 18 and at least a front portion of the base of midsole 14. The term "substantially covers" is defined herein to include covering with removable cover 26, except for those portions of removable cover 26 having decorative punch holes and perforations as well as air vents. Removable cover 26 is removably attached to internal support structure 12 substantially solely by pressure exerted internal support structure 12 on removable cover 26. In particular, toe box 18 and edges 38 of midsole 14 exert pressure on removable cover 26 to ensure that removable cover 26 is securely attached to internal support structure 12. The term "attached substantially solely by pressure" is defined herein as, the pressure exerted by internal support structure 12 on removable cover 26 is sufficient to ensure that removable cover 26 remains attached to internal support structure 12 during normal use of modular shoe system 10 even though, for example, other connection means between removable cover 26 and another element of modular shoe system 10 may make the attachment between removable cover 26 and internal support structure 12 more secure. For example, but not limited to, a positioning arrangement 42 which is described in more detail with reference to FIG. 2 and inter-engaging features 43 described in more detail below.

Modular shoe system 10 includes a plurality of interchangeable second removable covers, for example, a removable cover 32. Other examples of suitable second removable covers are described with reference to FIGS. 4 to 7*v*. Removable cover 32 includes a rear upper 34 and a rear outsole 36. Each of the second removable covers is configured for being alternately removably attached to rear portion 22. When modular shoe system 10 is assembled, removable cover 32 substantially covers heel counter 16, at least a rear portion of the base of midsole 14, a rear portion of front outsole 30 and a part of front upper 28. The term "substantially covers" is defined herein to include covering with removable cover 32, except for those portions of removable cover 32 having decorative punch holes and perforations as well as air vents. Removable cover 32 is removably attached to internal support structure 12 substantially solely by pressure exerted internal support structure 12 on removable cover 32. In particular, heel counter 16 and edges 40 of midsole 14 exert pressure on removable cover 32 to ensure that removable cover 32 is securely attached to internal support structure 12. The term "attached substantially solely by pressure" is defined herein as, the pressure exerted by internal support structure 12 on removable cover 32 is sufficient to ensure that removable cover 32 remains attached to internal support structure 12 during normal use of modular shoe system 10 even though, for example, other connection means between removable cover 32 and another element of modular shoe system 10 may make the attachment between removable cover 32 and internal support structure 12 more secure. For example, but not limited to, a positioning arrangement 42 which is described in more detail with reference to FIG. 2 and inter-engaging features 43 described in more detail below.

Modular shoe system 10 generally includes complementary inter-engaging features 43 for retaining removable cover 26 and removable cover 32 in position on internal support structure 12 (best shown by FIGS. 1*e* and 1*f*). In accordance with the preferred embodiment of the present invention, inter-engaging features 43 has a pin 44, a hole 46 and an indent 45. Hole 46 is typically disposed at the rear of front outsole 30. Pin 44 is typically disposed in the base of heel counter 16. Pin 44 engages into hole 46. Rear outsole 36 of removable cover 32 includes an indent 45 for accepting pin 44. It will be appreciated by those ordinarily skilled in the art that indent 45 can be disposed in heel counter 16 and pin 44 can be disposed in rear outsole 36. As described above, removable cover 26 is attached to internal support structure 12 solely by pressure exerted by internal support structure 12 on removable cover 26. Inter-engaging features 43 aid the wearer of modular shoe system 10 to correctly position removable cover 26 on internal support structure 12. Additionally, inter-engaging features 43 provide additional security to the wearer of modular shoe system 10 who may be worried about removable cover 26 and removable cover 32 slipping against internal support structure 12.

Removable cover 32 also includes a fastening arrangement 48 configured for securing modular shoe system 10 to a foot of a wearer. In accordance with the preferred embodiment of the present invention, fastening arrangement 48 includes a plurality of eyelets 50 configured for inserting a shoelace 51 through eyelets 50 (FIG. 1*g*). Other examples of fastening arrangement 48 are described with reference to FIGS. 4 to 6.

In accordance with the preferred embodiment of the present invention, removable cover 26 includes a tongue 52 configured for being disposed at least partially beneath fastening arrangement 48.

Figure 2:
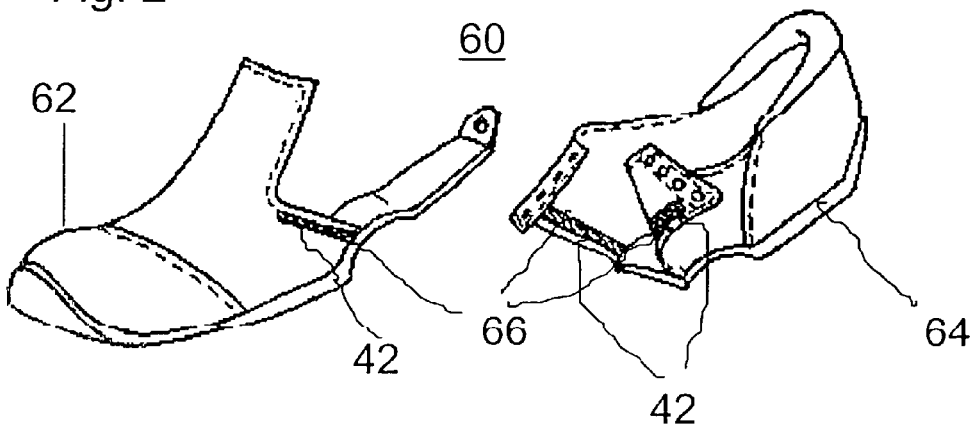
FIG. 2 is an isometric view of an alternate set of removable covers for use with the internal support structure of FIG. 1*c;*

Reference is now made to FIG. 2, which is an isometric view of a first alternate set of removable covers 60 for use with internal support structure 12 of FIG. 1*c*. Removable covers 60 include a front removable cover 62 and a rear removable cover 64. Removable covers 60 include positioning arrangement 42 configured for aiding a wearer to position front removable cover 62 and removable cover 64 relative to each other. Positioning arrangement 42 typically includes two sets of inter-engaging Velcro strips 66. Two of Velcro strips 66 are disposed on the outside of the tippers of front removable cover 62. Two complementary Velcro strips 66 are disposed on the inside of the uppers of removable cover 64. Velcro strips 66 are disposed, such that Velcro strips 66 are not visible when removable covers 60 are attached to internal support structure 12.

Figure 3A:
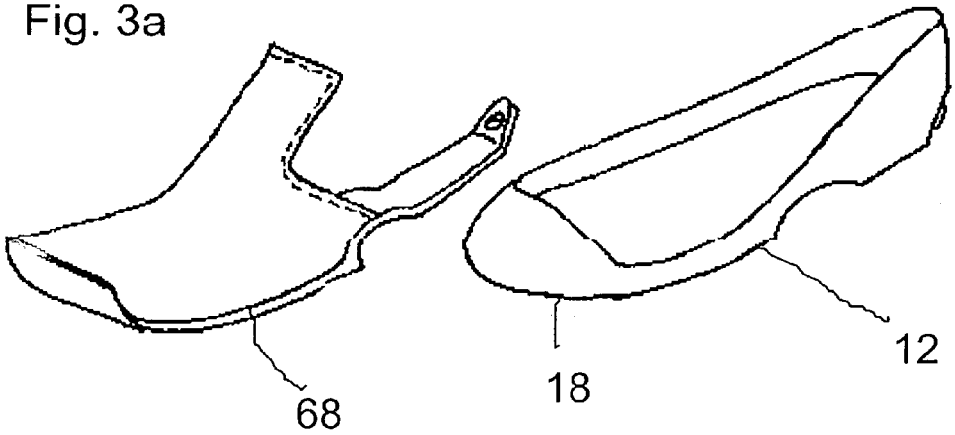
FIG. 3*a* is an isometric view of a square front removable cover for use with the internal support structure of FIG. 1*c;*
Figure 3B:
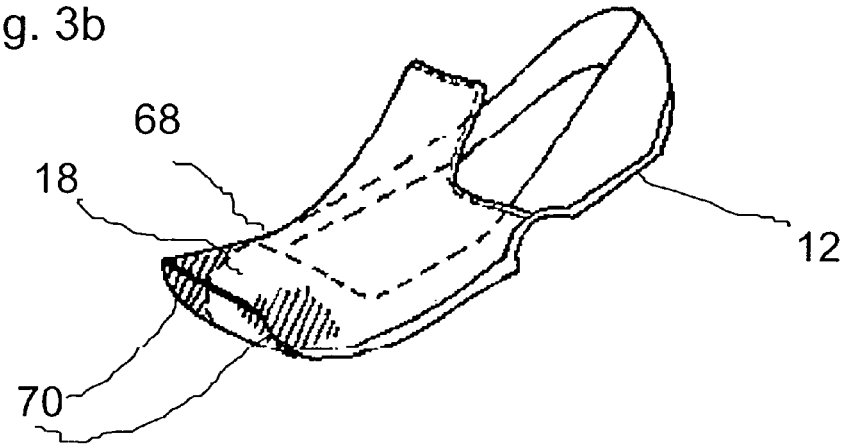
FIG. 3*b* is a schematic view of the square front removable cover of FIG. 3*a* attached to the internal support structure of FIG. 1*c;*

Reference is now made to FIG. 3*a*, which is an isometric view of a square front removable cover 68 for use with internal support structure 12 of FIG. 1*c*. Reference is also made to FIG. 3*b*, which is a schematic view of square front removable cover 68 of FIG. 3*a* attached to internal support structure 12 of FIG. 1*c* (for the sake of clarity and presentation, certain features which would otherwise be hidden are shown making other features semi-transparent). Removable cover 68 includes two filler sections 70 disposed therein, such that the outer shape of the toe section of removable cover 68 is different (in our example, square) from an outer shape of toe box 18 of internal support structure 12.

Figure 4:
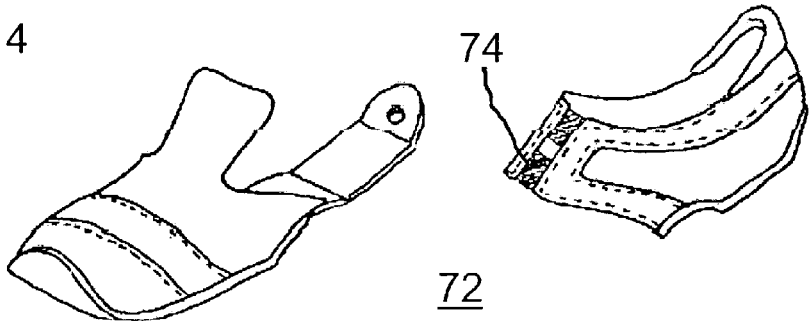
FIG. 4 is an isometric view of a pair of "slip-on" removable covers for use with the internal support structure of FIG. 1*c;*

Reference is now made to FIG. 4, which is an isometric view of a pair of "slip-on" removable covers 72 for use with internal support structure 12 of FIG. 1*c*. The rear removable cover 72 includes a fastening arrangement 74 having a stretchable band, configured for securing an assembled shoe to a foot of a wearer.

Figure 5:
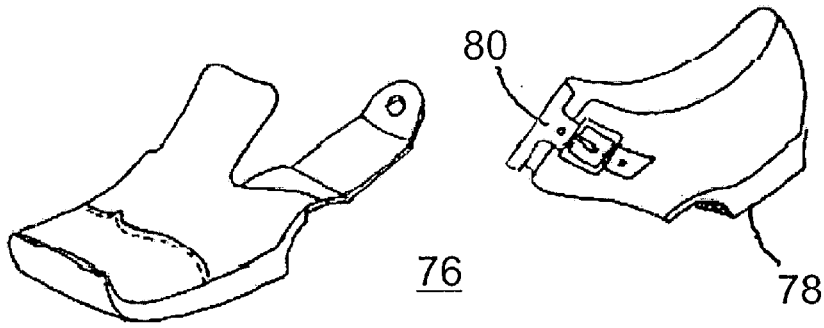
FIG. 5 is an isometric view of a pair of "buckle" removable covers with a heel for use with the internal support structure of FIG. 1*c;*

Reference is now made to FIG. 5, which is an isometric view of a pair of "buckle" removable covers 76 with a heel 78 for use with internal support structure 12 of FIG. 1*c*. The rear removable cover 76 includes a fastening arrangement 80 having a buckle, configured for securing an assembled shoe to a foot of a wearer. The rear removable cover includes pronounced heel 78 disposed thereon.

Figure 6:
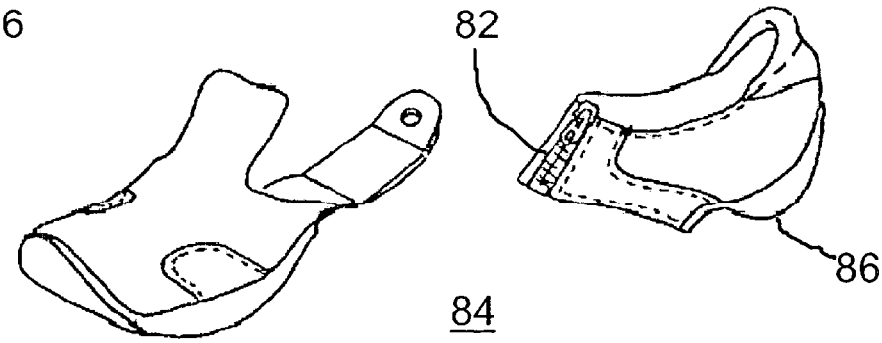
FIG. 6 is an isometric view of a pair of "zipper" removable covers with a heel for use with the internal support structure of FIG. 1*c;*

Reference is now made to FIG. 6, which is an isometric view of a pair of "zipper" removable covers 84 with a heel 86 for use with internal support structure 12 of FIG. 1*c*. Removable covers 84 includes a fastening arrangement 82 having a zipper, configured for securing an assembled shoe to a foot of a wearer.

Figures 7A, 7B, 7C, 7D, 7E, 7F, 7G:
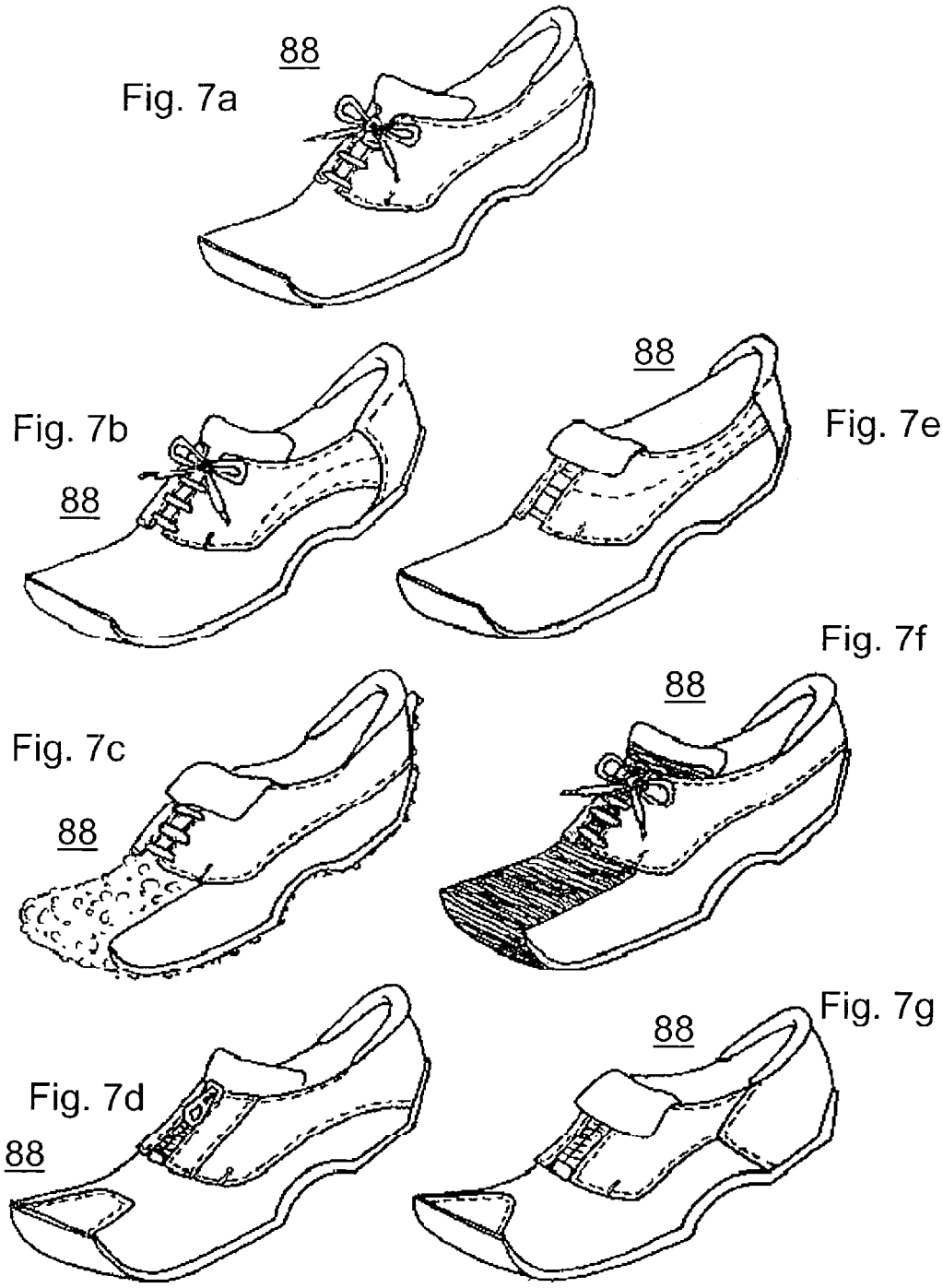
FIGS. 7*a* to 7*v* are isometric views of removable shoe covers attached to the internal support structure of FIG. 1*c*.
Figure 7H:
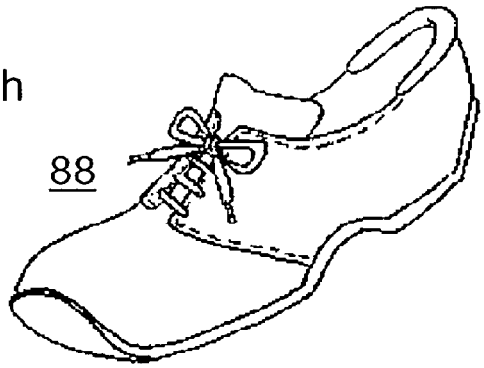
Figure 7I:
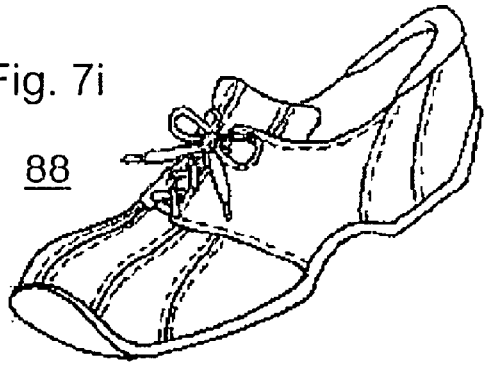
Figure 7L:
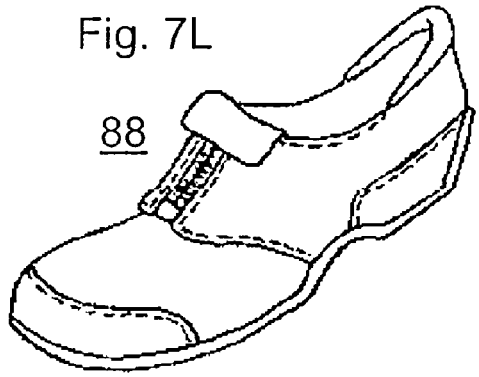
Figure 7J:
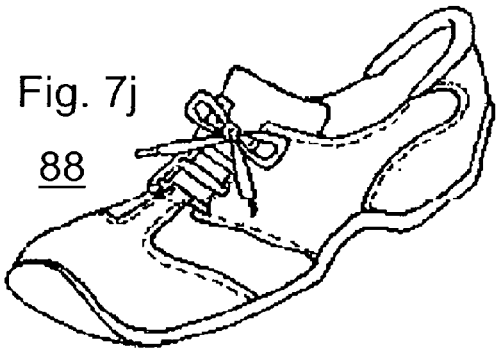
Figure 7M:
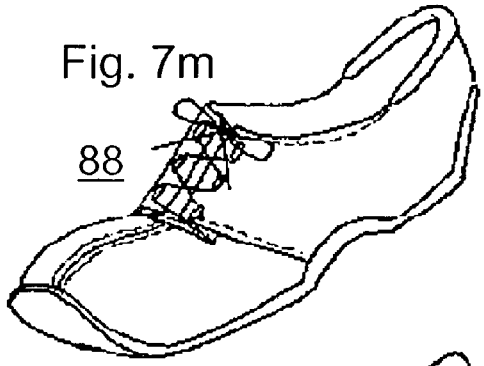
Figure 7K:
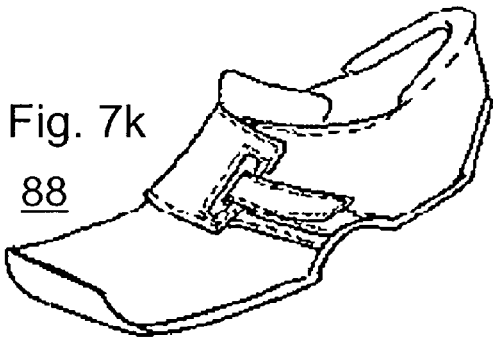
Figure 7N:
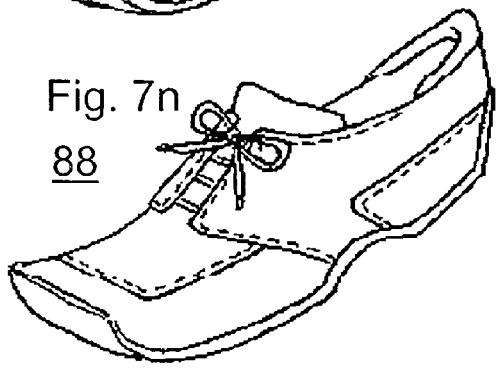
Figure 7O:
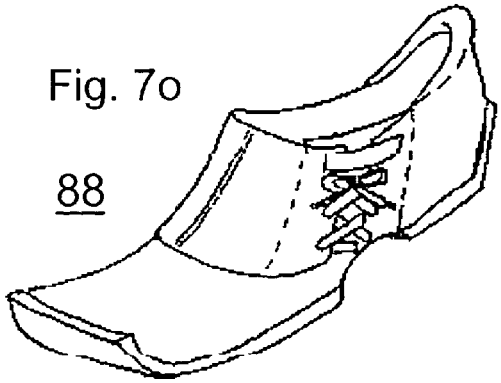
Figure 7S:
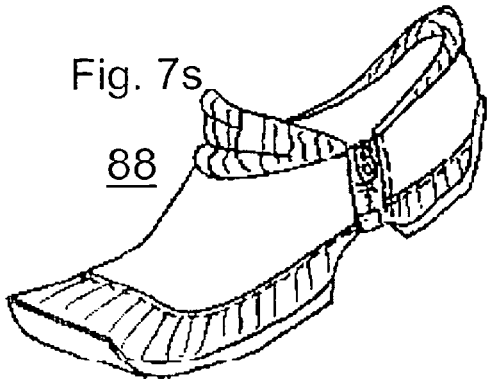
Figure 7P:
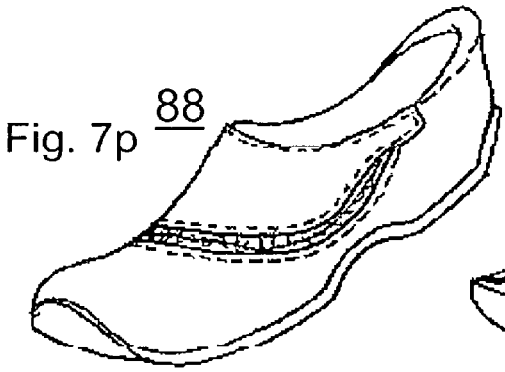
Figure 7T:
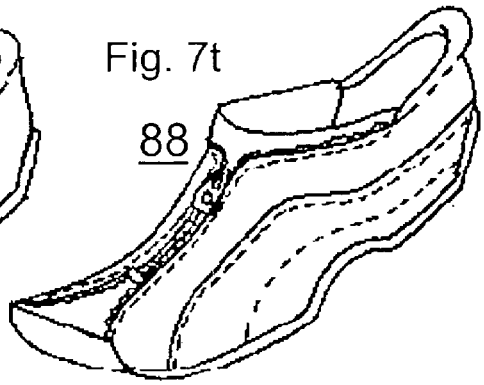
Figure 7Q:
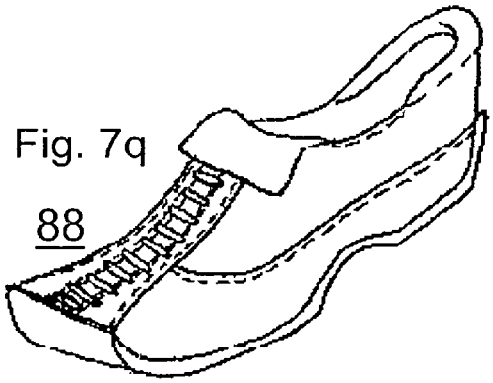
Figure 7U:
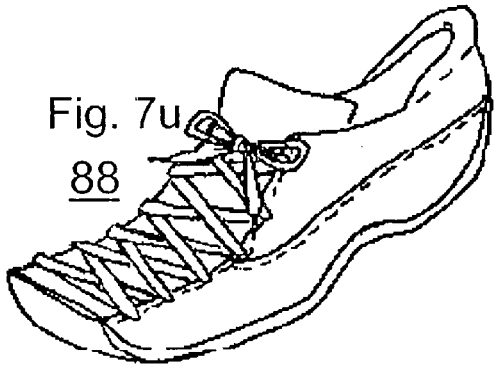
Figure 7R:
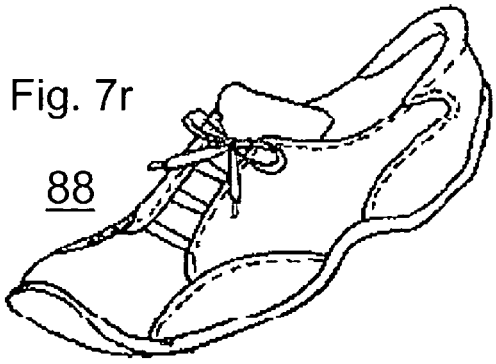
Figure 7V:
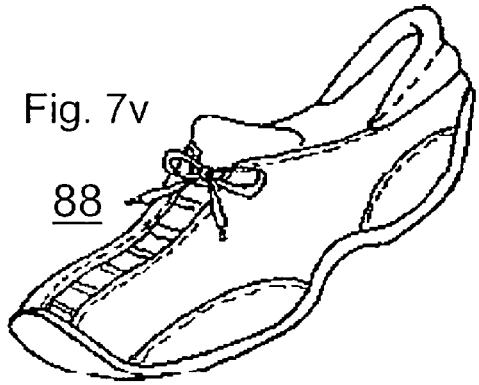

Reference is now made to FIGS. 7*a* to 7*v*, which are isometric views of removable shoe covers 88 alternately attached to internal support structure 12 of FIG. 1*c*. It will be appreciated by those ordinarily skilled in the art that the teachings of the modular shoe system of the present invention can be applied to form shoes of most shapes and designs including shapes and designs of both uppers and outsoles.

Figure 8A:
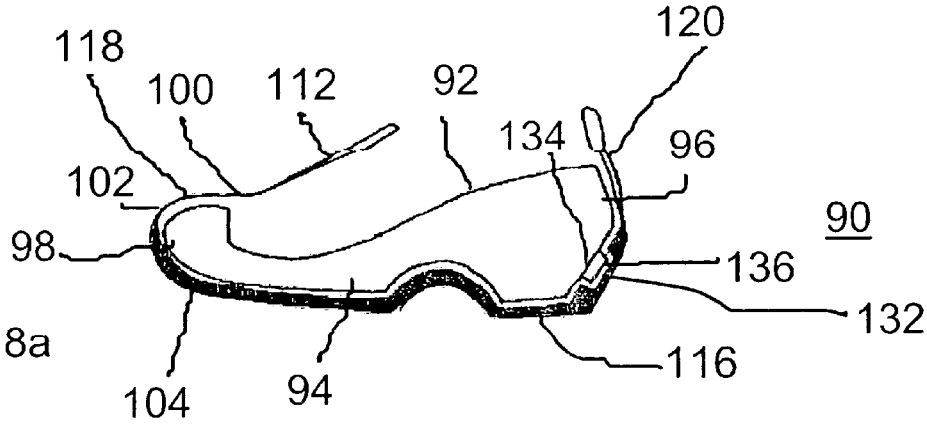
FIG. 8*c* is a schematic view of the modular shoe system of FIG. 5*a;*
Figure 8B:
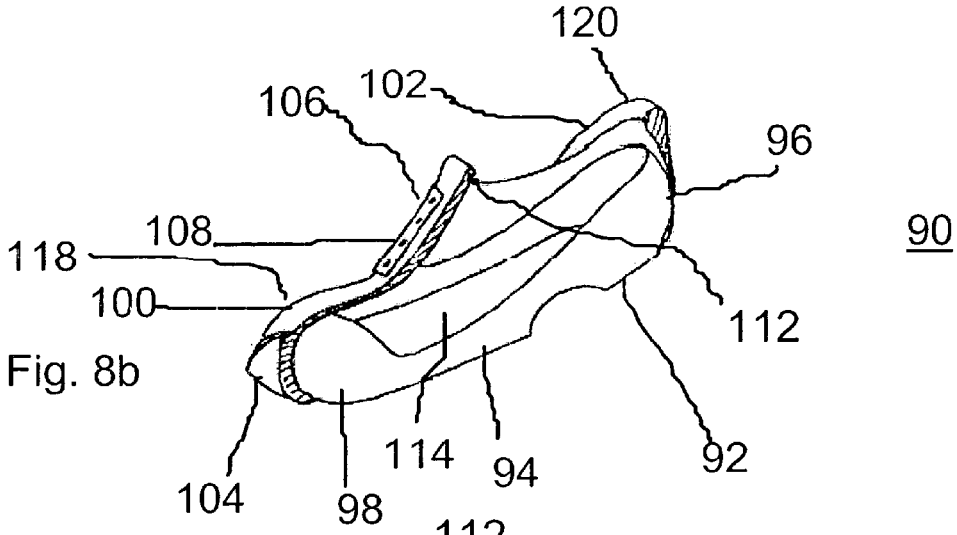
Figure 8C:
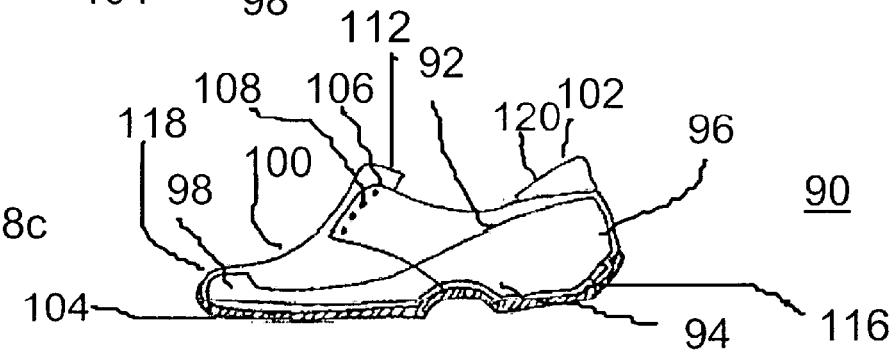

Reference is now made to FIGS. 8*a* to 8*c*. FIG. 8*a* is a sectional view of a modular shoe system 90 that is constructed and operable in accordance with a first alternate embodiment of the present invention. FIG. 8*b* is a partial view of shoe system 90 of FIG. 5*a* having a section of a removable cover 100 cut away. FIG. 8*c* is a schematic view of shoe system 90 of FIG. 8*a* (for the sake of clarity and presentation, certain features which would otherwise be hidden are shown making other features semi-transparent). Shoe system 90 includes an internal support structure 92. Internal support structure 92 includes a midsole 94, a heel counter 96 and toe box 98. Shoe system 90 also includes one-piece removable cover 100. Removable cover 100 includes an upper 102 and an outsole 104. Removable cover 100 is configured for being "simply removably attached" to internal support structure 92 substantially solely by pressure exerted by internal support structure 92 on removable cover 100. Internal support structure 92 is inserted into removable cover 100 by first inserting toe box 98 into removable cover 100 and then pushing heel counter 96 into removable cover 100. When shoe system 90 is assembled, a toe portion 118 of upper 102 substantially covers toe box 98 and a rear portion 120 of upper 102 covers heel counter 96. The term "simply removably attached" is defined herein as, removable cover 100 does not need to be assembled around internal support structure 92 in order for removable cover 100 to cover internal support structure 92. By way of a non-limiting example, removable cover 100 does not need to be zipped up or buttoned together in order for removable cover 100 to cover internal support structure 92. It should be noted that removable cover 100 may require to be bent in order to insert internal support structure 92 into removable cover 100. The term "attached substantially solely by pressure" is defined herein as, the pressure exerted by internal support structure 92 on removable cover 100 is sufficient to ensure that removable cover 100 remains attached to internal support structure 92 during normal use of shoe system 90 even though, for example, other connection means between removable cover 100 and another element of shoe system 90 may make the attachment between removable cover 100 and internal support structure 92 more secure. For example, but not limited to, inter-engaging features 132 described in more detail below with reference to FIG. 5*a*. It should also be noted that removable cover 100 does not generally include zips or other fastening mechanisms except for a fastening arrangement 106 "configured for securing shoe system 90" to the foot of the wearer. The term "configured for securing the shoe" is defined herein as, even if internal support structure 92 includes a securing arrangement configured to secure internal support structure 92 to the foot of the wearer, then if the securing arrangement of internal support structure 92 is removed, such that internal support structure 92 is no longer independently securable to the foot of the wearer, then shoe system 90 is still securable to the foot of the wearer using fastening arrangement 106. It should be noted that internal support structure 92 is preferably not independently securable to the foot of the wearer. In other words, if internal support structure 92 is worn without removable cover 100, internal support structure 92 will not be retained securely on the foot of the wearer, for example, internal support structure 92 could be kicked off the wearer's foot by the wearer. Fastening arrangement 106 includes plurality of eyelets 108 configured for inserting a shoelace (not shown) through eyelets 108. It will be appreciated by those ordinarily skilled in the art that fastening arrangement 106 can be implemented in other forms, for example, but not limited to a stretchable band and a buckle. Removable cover 100 also includes a tongue 112 disposed at least partially beneath fastening arrangement 106. Outsole 104 of removable cover 100 also includes a heel 116. Shoe system 90 also includes an insole 114 disposed in internal support structure 92.

Reference is now made to FIG. 5*a*. Shoe system 90 generally includes complementary inter-engaging features 132 for retaining removable cover 100 in position on internal support structure 92. In accordance with the preferred embodiment of the present invention, inter-engaging features 132 has a pin 134 and an indent 136. Pin 134 is disposed on internal support structure 92 and indent 136 is disposed in removable cover 100. It will be appreciated by those ordinarily skilled in the art that indent 136 can be disposed in internal support structure 92 and pin 134 can be disposed on removable cover 100. As described above, removable cover 100 is attached to internal support structure 92 solely by pressure exerted by internal support structure 92 on removable cover 100. Inter-engaging features 132 aid the wearer of shoe system 90 to correctly position removable cover 100 on internal support structure 92. Additionally, inter-engaging features 132 provide additional security to the wearer of shoe system 90 who may be worried about removable cover 100 slipping against internal support structure 92.

It will be appreciated by those ordinarily skilled in the art that the shape of removable cover 100, in particular the shape of the toe section of removable cover 100 can be defined using filler sections inside removable cover 100, the filler sections filling the gap between toe box 98 and removable cover 100. It will be appreciated by those ordinarily skilled in the art although toe box 98 has been shown as having a generally rounded shape, toe box 98 can be other shapes for example, but not limited to a flat end and a pointed end.

Figure 9A:
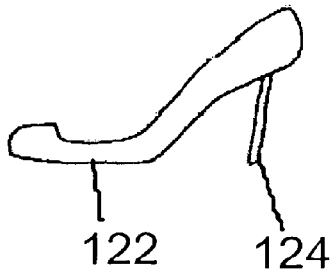
FIG. 9*a* is a side view of an internal support structure having an elongated element disposed thereon that is constructed and operable in accordance with a first alternate embodiment of the present invention.
Figure 9B:
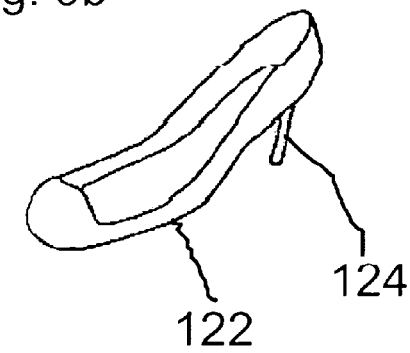
FIG. 9*b* is an isometric view of the internal support structure of FIG. 9*a;*
Figure 9C:
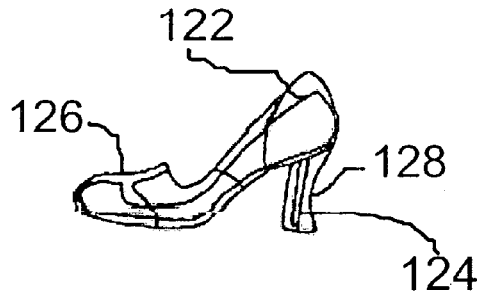
FIG. 9*c* is a schematic view of the internal support structure of FIG. 9*a* inserted into a removable cover.

Reference is now made to FIGS. 9*a* to 9*c*. FIG. 9*a* is a side view of an internal support structure 122 having an elongated element 124 disposed thereon that is constructed and operable in accordance with a first alternate embodiment of the present invention. FIG. 9*b* is an isometric view of internal support structure 122 of FIG. 9*a*. FIG. 9*c* is a schematic view of internal support structure 122 of FIG. 9*a* inserted into a removable cover 126 (for the sake of clarity and presentation, certain features which would otherwise be hidden are shown making other features semi-transparent). Elongated element 124 is configured for insertion into a heel 128 of removable cover 126. Elongated element 124 reduces both rotation and sideways movement of removable cover 126 with respect to internal support structure 122. Additionally, elongated element 124 aids positioning of removable cover 126 on internal support structure 122 as well as preventing any wobbling of heel 128.

Figure 9D:
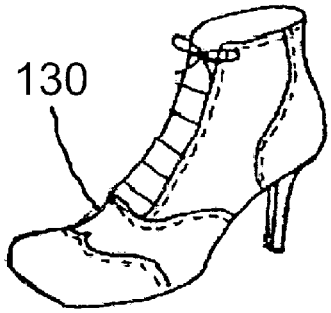
FIG. 9*d* to 9*f* are isometric views of assembled shoes using the internal support structure of FIG. 9*a.*
Figure 9E:
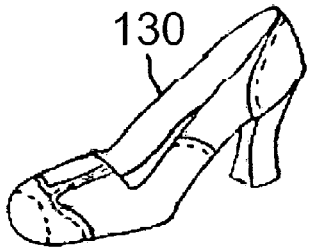
Figure 9F:
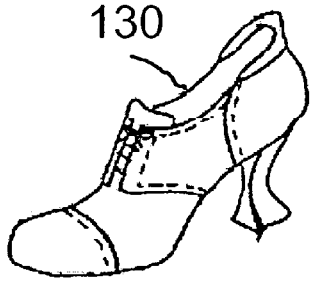

Reference is now made to FIG. 9*d* to 9*f* are isometric views of assembled shoes 130 using internal support structure 122 of FIG. 9*a*.

It will be appreciated by persons skilled in the art that the present invention is not limited to what has been particularly shown and described hereinabove. Rather, the scope of the present invention includes both combinations and sub-combinations of the various features described hereinabove, as well as variations and modifications thereof that are not in the prior art which would occur to persons skilled in the art upon reading the foregoing description.

What is claimed is:

1. A modular shoe system having interchangeable uppers and outsoles, comprising:

(a) an internal support structure consisting of a midsole, said midsole having a first longitudinal end and a second longitudinal end, said midsole including a heel counter at said second longitudinal end thereof;

(b) a plurality of interchangeable one-piece removable cover arrangements, each of said interchangeable one-piece removable cover arrangements consisting of an upper and an outsole, at least two of the interchangeable one-piece removable covers having different exterior shapes by having at least different uppers each of said interchangeable one-piece removable cover arrangements configured for being alternately removably attached to said internal support structure substantially solely by pressure exerted by said heel counter on each one-piece removable cover arrangement, the internal support structure supporting the upper when attached to the cover arrangement, the cover arrangements further including inter-engaging features for interacting with the heel counter of the internal support structure and retaining the cover arrangement in position when attached to the internal support structure.

2. A modular shoe system providing a footwear including at least a support structure, an upper, and an outsole, comprising:

A first cover and a second cover, each cover consisting of an upper and an outsole, each upper having a heel portion and a toe section, the first upper including a filler section at least within said toe section to define a first shape thereof, the second upper including a filler section at least within said toe section to define a second shape thereof, the second shape is different from the first shape, each cover including an engagement element about the heel portion;

an internal support structure consisting of a midsole, said midsole having a first longitudinal end and a second longitudinal end, said midsole including a toe box at said first longitudinal end and a heel counter at said second longitudinal end, the internal support structure including an engagement element about the heel counter, the internal support structure configured for insertion into both the first cover and the second cover and for providing support to the upper of each cover and to align with the cover by mating of the cover engagement element and the internal support structure engagement element so as to provide a first shoe having a first shape and a second shoe having a second shape, the internal support structure removably attached to said cover substantially solely by pressure exerted by said internal support structure on the cover of each one-piece removable cover arrangement.

3. An interchangeable cover modular shoe, comprising:

a plurality of covers, each cover consisting of an upper and an outsole, the upper including a heel portion, a midsection, and a toe portion, at least two of the covers having different exterior appearances by having at least different uppers the heel portion including a first engagement feature; and a support structure configured for insertion into each of said covers, the support structure consisting of a midsole, said midsole having a first longitudinal end and a second longitudinal end, said midsole including a toe cap at said first longitudinal end a heel counter at said second longitudinal end, the heel counter including a second engagement feature, the support structure configured to be inserted into each of said covers and align the heel counter with said heel portion and the toe cap with the toe portion by mating of the first and second engagement features so as to provide internal support to the upper of each cover at least by said heel counter providing structural support to said cover heel portion, the toe cap support providing structural support to said cover toe portion.

4. A modular shoe, comprising:

a plurality of covers, each cover consisting of an upper and an outsole, the outsole having a bottom face, an upper face, and an outer edge, the upper portion of the removable cover extending along the entire outer edge of the outsole and is coupled to the outsole along said entire outer edge, at least two of the covers having different exterior appearances by having at least different uppers;

an internal support structure consisting of a midsole, said midsole having a first longitudinal end and a second longitudinal end, said midsole including a heel counter at said second longitudinal end, said midsole including a toecap at said first longitudinal end, said midsole further including an edge wall extending perpendicular to the base of the midsole and extending between said heel counter and said toecap to provide edge coverage along the outer edge of the midsole base, the internal support structure configured for insertion into each cover and for providing support to the cover by constant pressure exerted by said internal support structure heel counter, toecap, and edge wall on the upper face and outsole of each one-piece removable cover arrangement.

* * * * *